US005669726A

United States Patent [19]

Karlis et al.

[11] Patent Number: 5,669,726

[45] Date of Patent: Sep. 23, 1997

[54] SHEET OF PAPER CLIPS WITH A SINGLE LEG ATTACHMENT

[75] Inventors: Robert G. Karlis, Hingham; Gordon A. Vinther, Pepperell, both of Mass.

[73] Assignee: Clix Products, Inc., Natick, Mass.

[21] Appl. No.: 500,262

[22] Filed: Jul. 10, 1995

Related U.S. Application Data

[60] Division of Ser. No. 291,279, Aug. 16, 1994, which is a continuation-in-part of Ser. No. 145,955, Nov. 1, 1993, Pat. No. 5,419,018.

[51] Int. Cl.[6] ..... B42F 3/00

[52] U.S. Cl. ..... 402/4; 402/79

[58] Field of Search ..... 281/38, 21.1, 15.1, 281/51; 402/4, 79, 80 R; 206/336, 822; 24/67 R, 67.11, 67.9, DIG. 8

[56] References Cited

U.S. PATENT DOCUMENTS

| | | | |
|---|---|---|---|
| 1,619,893 | 3/1927 | Stoer | 206/336 X |
| 5,291,995 | 3/1994 | von Agris et al. | 206/336 |
| 5,480,192 | 1/1996 | Angerbaner et al. | 402/79 X |
| 5,501,540 | 3/1996 | Ho | 402/79 X |

*Primary Examiner*—Willmon Fridie, Jr.

*Attorney, Agent, or Firm*—Morse, Altman & Benson

[57] ABSTRACT

For mounting in a notebook having outer covers and a spine, a sheet of clips comprises: a frame having inner and outer side rims, top and bottom cross rims, and optionally at least a rib connected between a pair of the rims; a set of paper clips integrally connected to the frame via the rims and the rib; each of the clips including an outer retainer, an inner retainer and a yoke connecting the outer retainer and the inner retainer; a rupturable junction extending between the frame and the yoke.

13 Claims, 15 Drawing Sheets

SHEET OF PAPER CLIPS WITH A SINGLE LEG ATTACHMENT

RELATED APPLICATION

The present application is a divisional application of application Ser. No. 08/291,279, dated Aug. 16, 1994 for PLASTIC PAPER CLIP AND INTEGRAL SHEET-LIKE PACKAGING THEREOF in the names of inventors Robert G. Karlis and Gordon A. Vinther, which, in turn, is a continuation-in-part of application, Ser. No. 08/145,955, dated Nov. 1, 1993, now U.S. Pat. No. 5,419,018, for SHEET OF CLIPS in the names of inventors Robert G. Karlis, Linda M. Gauger, and Richard J. Keohan.

FIELD OF THE INVENTION

The present invention relates to paper clips and, more particularly, to their packaging. Still more particularly, the present invention relates to paper clips that are composed of plastic and joined together integrally prior to being separated for use.

THE PRIOR ART

Traditionally, paper clips have been in the well-known form of integral, spring-metal wire configurations having inner and outer elongated arches, one leg of each of which is connected by a yoke that: (1) flexes when the arches are spread apart to accommodate reception of sheets of paper, and (2) recoils when the arches are released to clasp the sheets of paper therebetween. The arrangement is such that the spring-metal yoke exerts effective forces of flexure and torsion. However, the ends of the free legs tend to gouge the paper sheets and the elongated arches tend not to lie flat against the paper sheets. Such paper clips are not particularly aesthetic.

More recently marketed have been plastic paper clips in a variety of configurations, some of which are analogous to the traditional spring-metal configuration. More typically, however, these plastic paper clips have inner and outer closed elongated U-shaped or V-shaped arches, both legs of each of which are integrally connected at a yoke. In the past, the plastic yoke has not provided sufficient forces of flexure and torsion to enable the inner and outer arches to firmly clasp the paper sheets therebetween. Also the inner and outer arches have not tended to lie flat against the paper sheets. An advantage inherent in plastic paper clips is the array of colors that are feasible. But in the past, configurations of such clips have been marred by burrs along their peripheries as a result of molding procedures.

Typically, both spring-metal and plastic paper clips have been packaged in small cardboard boxes, in transparent plastic bags or cylinders, or in other three dimensional containers. These containers often are easy to misplace and inconvenient to transport. There have been a few proposals for small pads of integrally connected plastic clips, which can be disconnected from each other by twisting or bending. These pads and their clips, in general, suffer from many of the same problems as did the containers of the clips discussed above. In addition, the point at which such a clip was disconnected from its pad tended suffer from a burr on an otherwise smooth profile. Such a burr can be unsightly and can scratch a user's finger.

SUMMARY OF THE INVENTION

The primary object of the present invention is to provide, for attachment to and presentation by a notebook in the same manner as the sheets of paper in the notebook, a sheet of clips comprising a frame that is adapted for connection to the notebook spine, ribs that are connected between rims of the frame, and clips that are detachably connected to either or both the rims and the ribs. In one form, one rim of the frame is provided with spaced holes for the reception of the rings of a loose leaf notebook. In another form, one rim of the frame is provided with detents or catches that snap between the coils of a spiral binder.

Preferably, each plastic clip integrally comprises inner and outer retainers that are integrally connected by a yoke and are otherwise free for the reception of paper sheets therebetween. The outer retainer is in the form of an elongated arch, the legs of which are connected to the yoke. At the outer edge of the yoke are protruding knurls which are small but discernible. The yoke is anchored to the frame at one or more junctions, which cleave when the clip is bent outwardly with respect to the frame. As a result of this cleaving, the clip becomes free of the frame at the junction, and at least one residual burr protrudes from the yoke in the vicinity of the junction. This burr, however, is positioned among the protruding knurls. Visually, the burr among the knurls merely appears to be another knurl. In use, the burr is prevented by the knurls from scratching the fingers. Thus the burr, which under ordinary circumstances would be an obtrusive and uncomfortable imperfection in an otherwise pleasing profile, becomes merely a decorative aspect of that profile.

The present invention lends itself to a variety of clip configurations within the aforementioned parameters. In one such configuration, the inner retainer includes a planar tablet that is adapted to receive alphanumeric or artistic presentations for advertising or decorative purposes. In one case, the sheet of clips, as a whole, is silk screened to provide inked surfaces on the clips with information, logos, advertising or other coordinated subject matter. In another case, the tablet is embossed during molding to provide relief or raised coordinated subject matter. In a further case, the surfaces of the tablets are treated to provide a microstriated surface texture capable of being marked manually with a message or symbol by pen and ink.

BRIEF DESCRIPTION OF THE DRAWINGS

For a fuller understanding of the nature and objects of the present invention, reference is made to the following specification, which is to be taken in connection with the accompanying drawings wherein.

DETAILED DESCRIPTION OF THE PREFERRED EMBODIMENTS

Figure 1:
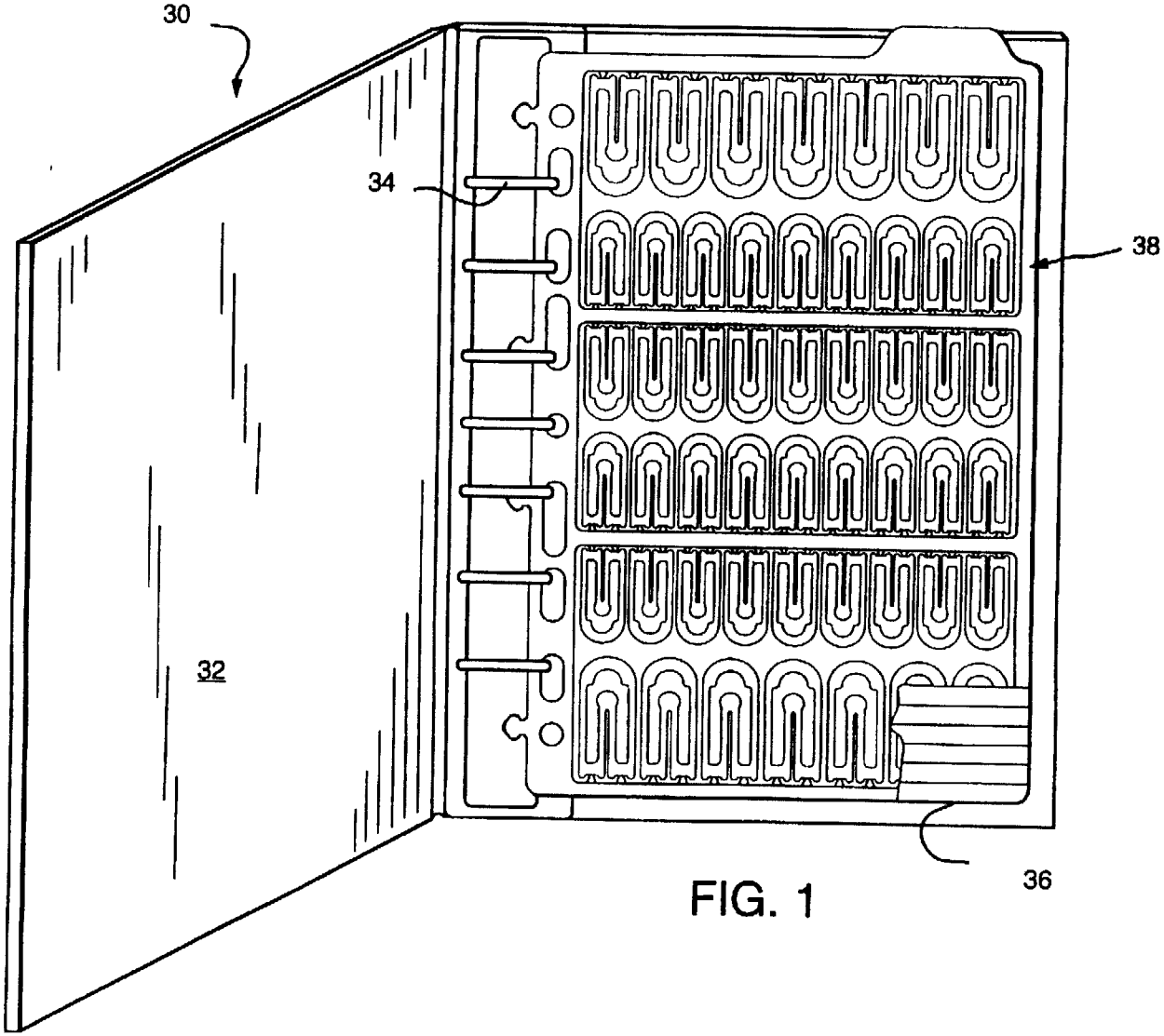
FIG. 1 is a perspective view of a loose leaf notebook and sheet of clips, in combination, embodying the present invention.
Figure 2:
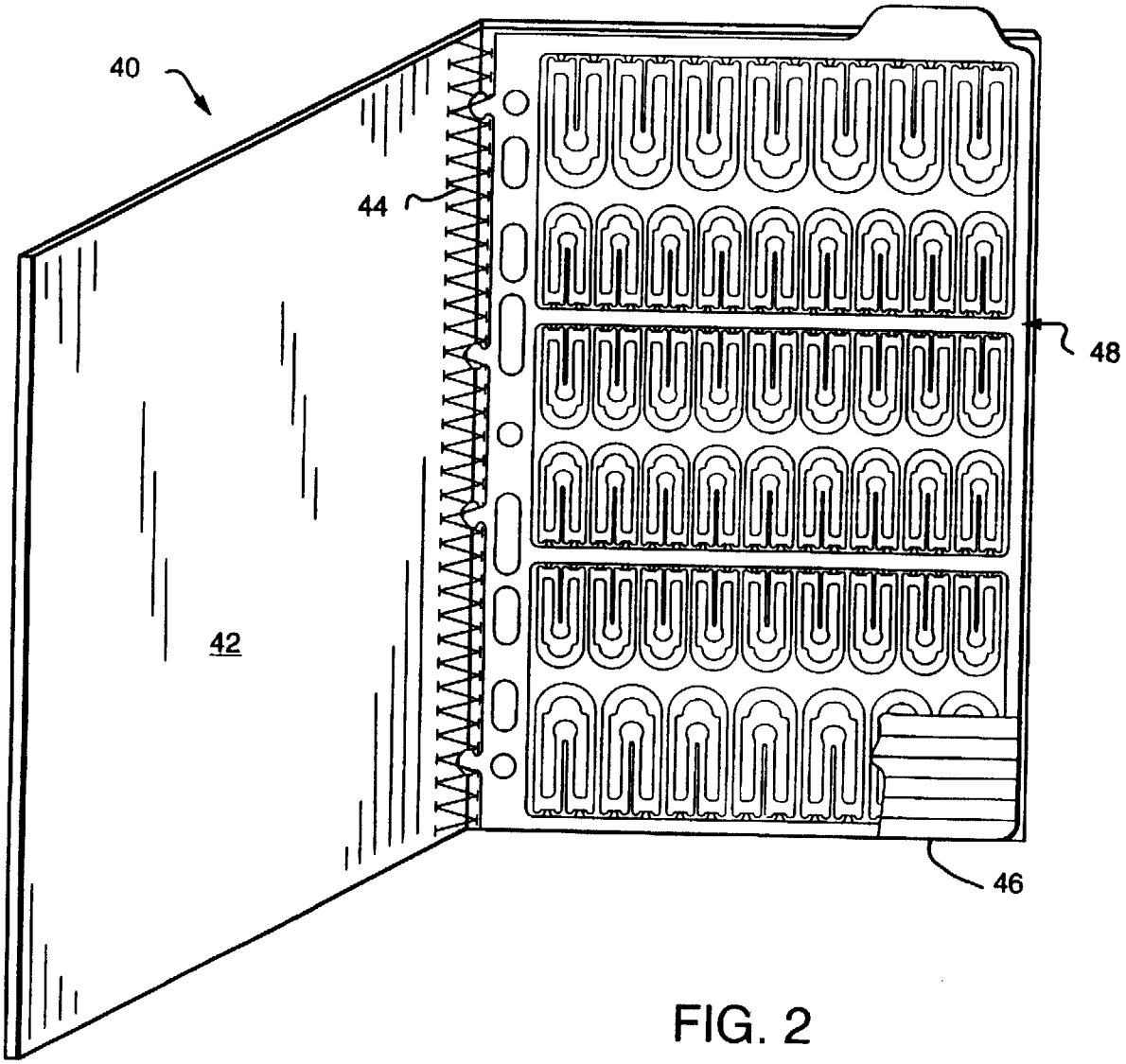
FIG. 2 is a perspective view of a spiral bound notebook and sheet of clips, in combination, embodying the present invention.

The Notebook of FIGS. 1 and 2

FIG. 1 illustrates a loose leaf notebook 30 that typically comprises a binder 32, a plurality (in this case three) of snap-open, snap-shut rings 34 carried by the binder spine, a stack 36 of paper sheets with punched holes that receive rings 34, and a plastic sheet of clips 38 embodying the present invention. The structure of binder 32, rings 34 and punched paper sheets 36, of course, are well known. The most common loose-leaf binder size in the United States is designed for punched paper sheets that are 8½×11 inches in dimension. However, smaller and other dimensioned loose-leaf binder sizes and shapes are contemplated by the present invention.

FIG. 2 illustrates a spiral bound notebook 40 that typically comprises a binder 42. Binder 42 is shown as comprising a front and back cover and a spine in the form of a helical metal or plastic coil 44. Binder 42 carries a stack of perforated paper sheets 46 and a plastic sheet of clips 48 embodying the present invention. The sizes of such spiral bound notebooks vary widely.

In the preferred embodiments of FIGS. 1 and 2, sheets of clips 38 and 48 are detachable from notebooks 30 and 40, as will be explained below. It is to be understood that, in its broadest sense, the present invention also contemplates incorporating a sheet of clips into a book permanently.

The Clips of FIGS. 3 to 5*b*

Figure 3:
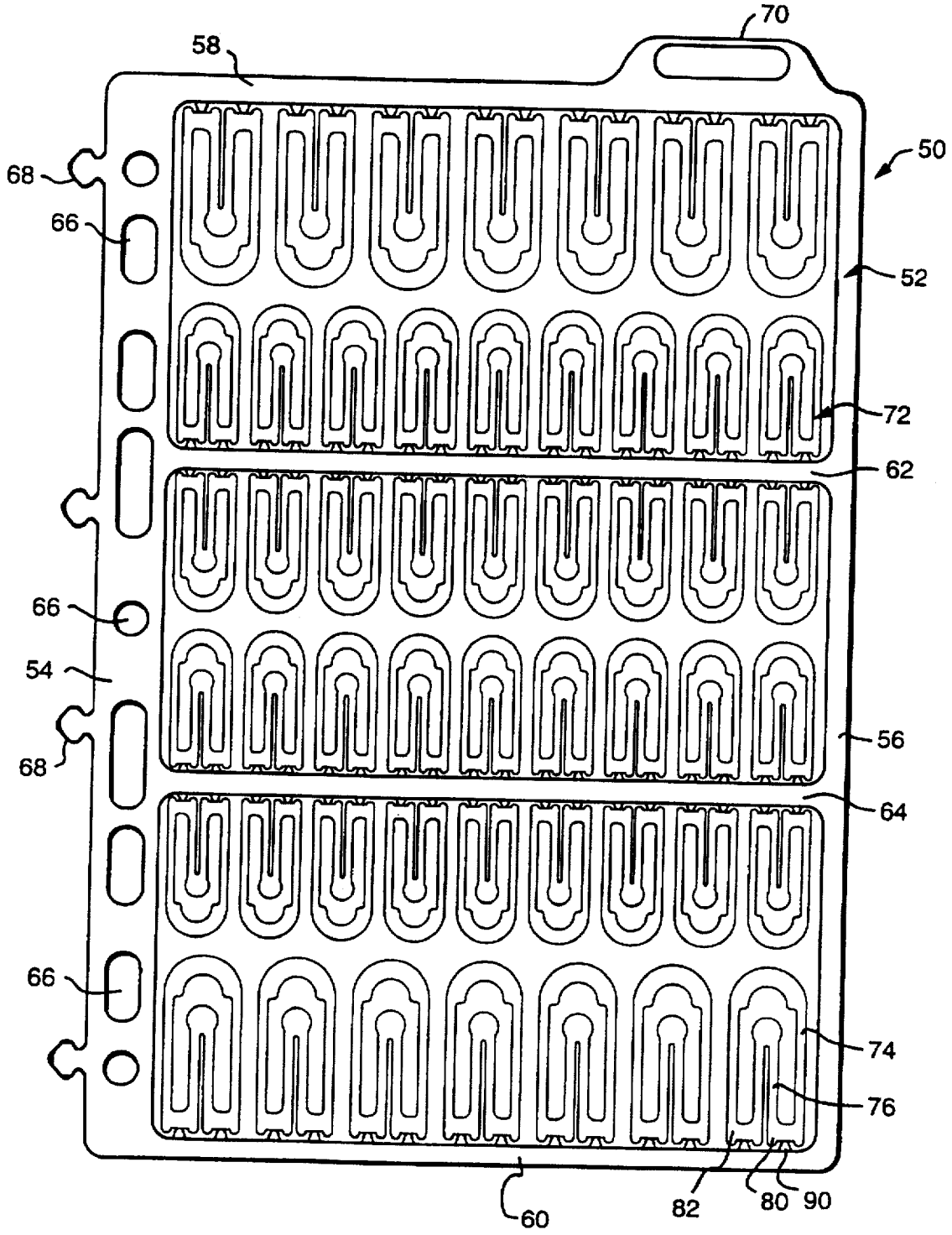
FIG. 3 is a plan view of one form of a sheet of clips embodying the present invention.

FIG. 3 illustrates a sheet of clips 50 that comprises a frame 52 having: opposed inner and outer side rims 54, 56; opposed top and bottom cross rims 58, 60; and a pair or medial cross ribs 62, 64. As shown, side rims 54, 56 are parallel. Rims 58, 60 and ribs 62, 64 are perpendicular with respect thereto. Frame 52 is sufficiently thick to ensure the dimensional stability of the sheet of clips. Inner side rim 54 includes holes 66 for the reception of the three rings of loose leaf notebook 30 and the retention of the sheet of clips in the notebook. Inner side rim 54 also includes extending catches 68 which are adapted for projection through the interstices between the loops of coil 44 of spiral bound notebook 40 and for preventing retraction back through these interstices. One of the other rims, in this case the upper rim, is provided with a visual tab 70 for ready identification of the size and style of the clips that are being carried by the frame. It is to be understood that, in alternative versions of the sheet of clips of FIG. 3, only the holes or only the catches may be present.

Figure 4A:
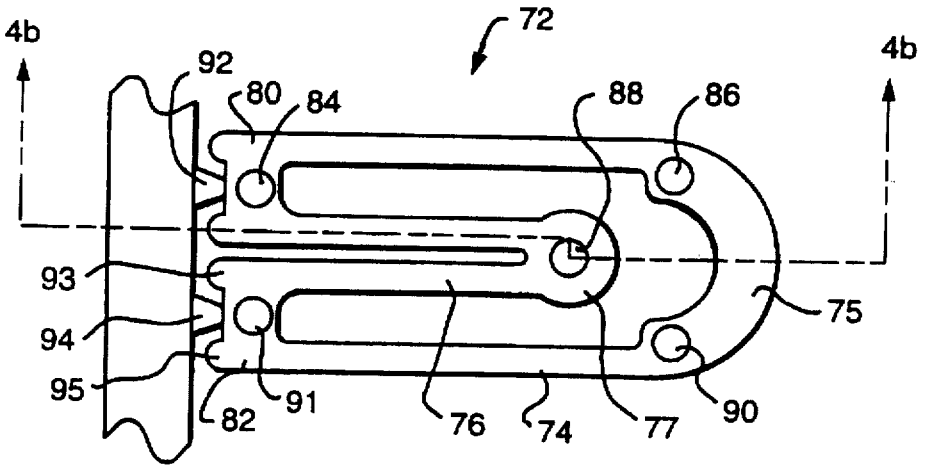
FIG. 4*a* is an enlarged fragmentary view of a portion of the sheet of clips of FIG. 3, showing the integral junction between the clip and part of the frame.
Figure 4B:
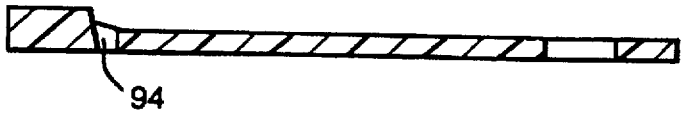
FIG. 4*b* is a cross section of FIG. 4*a*, taken along the line 4*b*—4*b;*

As shown, rows of clips 72 are connected to cross rims 58, 60 and cross ribs 62, 64. As shown in FIGS. 3, 4*a* and 4*b*, each clip comprises an outer retainer in the form of an elongated arch 74 and an inner retainer in the form of an elongated arch 76. The pairs of adjacent legs of retainers 74, 76 are integrally connected to a split yoke 80, 82. Generally, the legs of retainers 74, 76 all are of approximately the same transverse dimension. The longitudinal dimensions of the tips 75, 77 of retainers 74, 76 and of split yoke 80, 82 are significantly greater. This dimensional differential permits the legs of the arches to undergo torsion and flexure in use, while limiting deformation of tips 75, 77 and split yoke 80, 82.

The sheet of clips is formed by injection molding of molten polymer through fill gates that are located at the positions of junctions 92, 94, which will be discussed in detail below. Each clip cavity in the mold has two fill gates which are located between the locations of knurls, which will be discussed in detail below. The circular, slightly depressed regions shown at 84, 86, 88, 90, 91 are vestiges of the molding process. At these points, ejector pins make contact with the individual clips and eject them from the mold when the mold is opened. These locations are deliberately chosen to obviate fault lines 96, 97 and to maximize integrity throughout the clip during the injection molding process. The added longitudinal thickness of tips 75, 77 and spit yoke 80, 82 are chosen for the same reason.

Figure 5A:
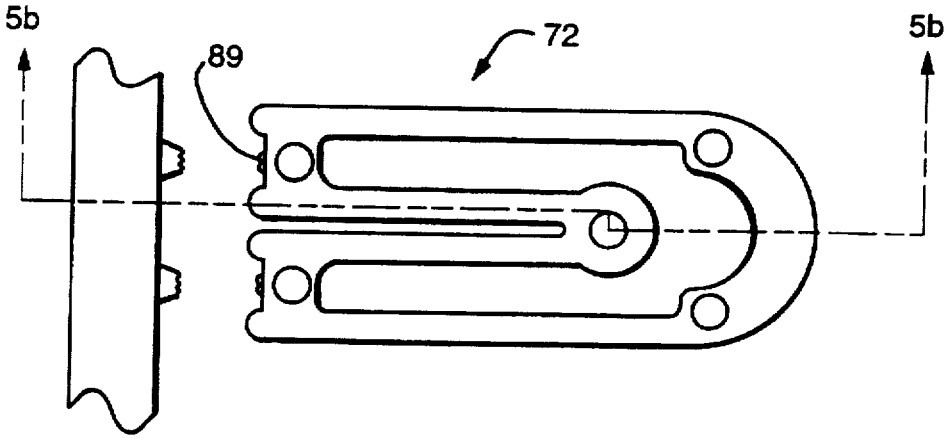
FIG. 5*a* is an enlarged fragmentary view of a portion of the sheet of clips, analogous to FIG. 4*a*, showing a ruptured junction between the clip and a part of the frame.
Figure 5B:
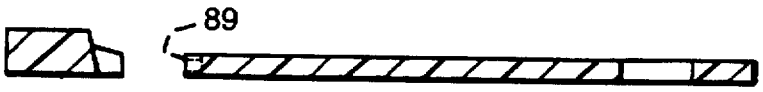
FIG. 5*b* is a cross-sectional view of FIG. 5*a*, taken along the line 5*b*—5*b;*

As seen in FIGS. 4*a*, 4*b*, each clip 72 is integrally connected to a rib or a rim by a pair of junctions 92, 94. These junctions conically or pyramidally converge from one of the rims or ribs, for example from rib 64, to positions on the split yoke. Each of these junctions is straddled by a pair of projections or knurls 93, 95 on the yoke. As seen in FIGS. 5*a*, 5*b*, when junctions 92, 94 are ruptured by repeated bending of the clip with respect to the frame, the clip becomes free for use and a burr 89 ordinarily remains between each pair of knurls 93, 95. Were it not set between adjacent knurls, the burr might scratch the fingers of a user and would appear as a visual imperfection. This burr instead is seen as a feature of the ornamentally knurled split yokes.

Figure 6:
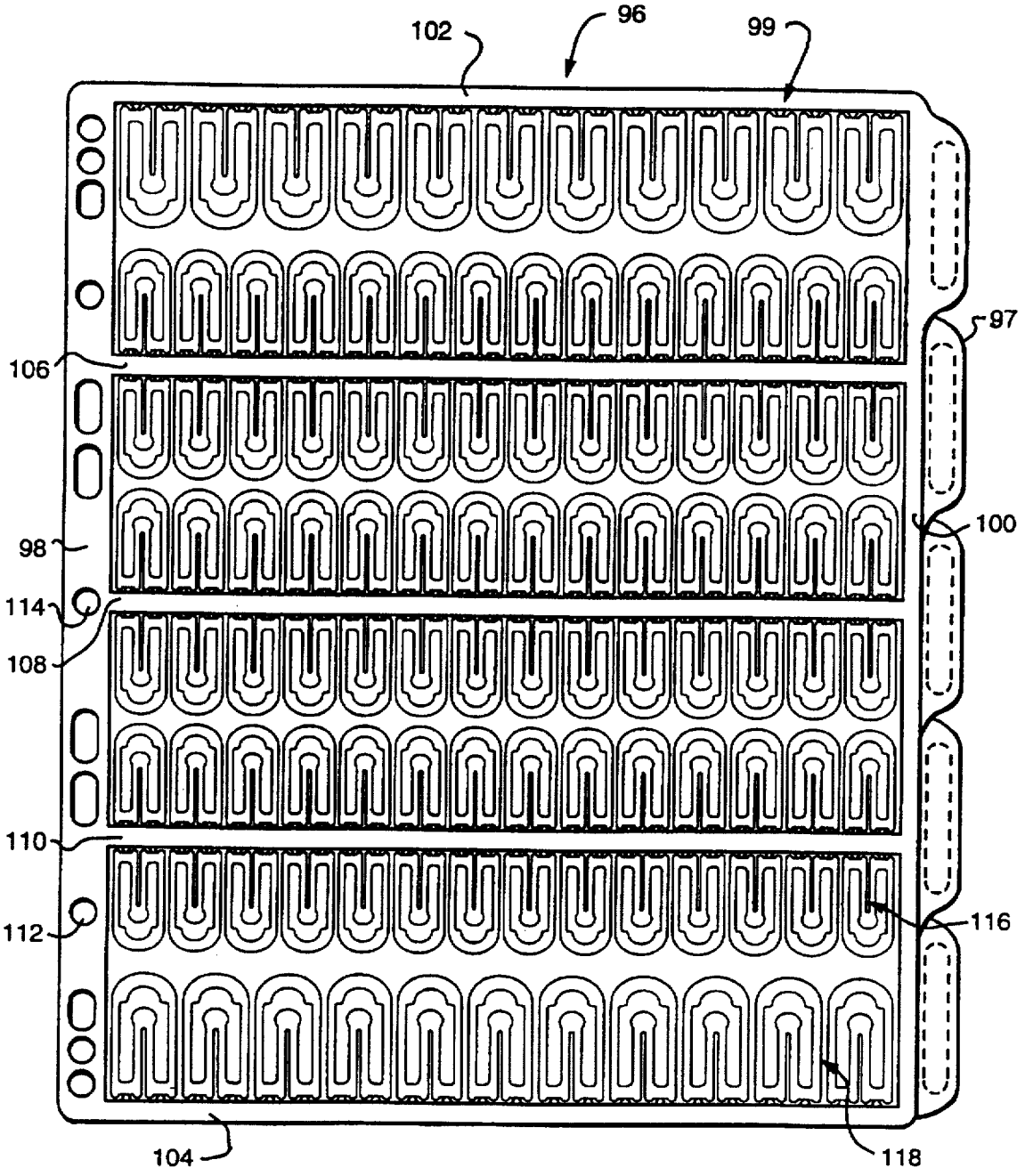
FIG. 6. is a plan view of an alternative sheet of clips, analogous to FIG. 3.
Figure 8A:
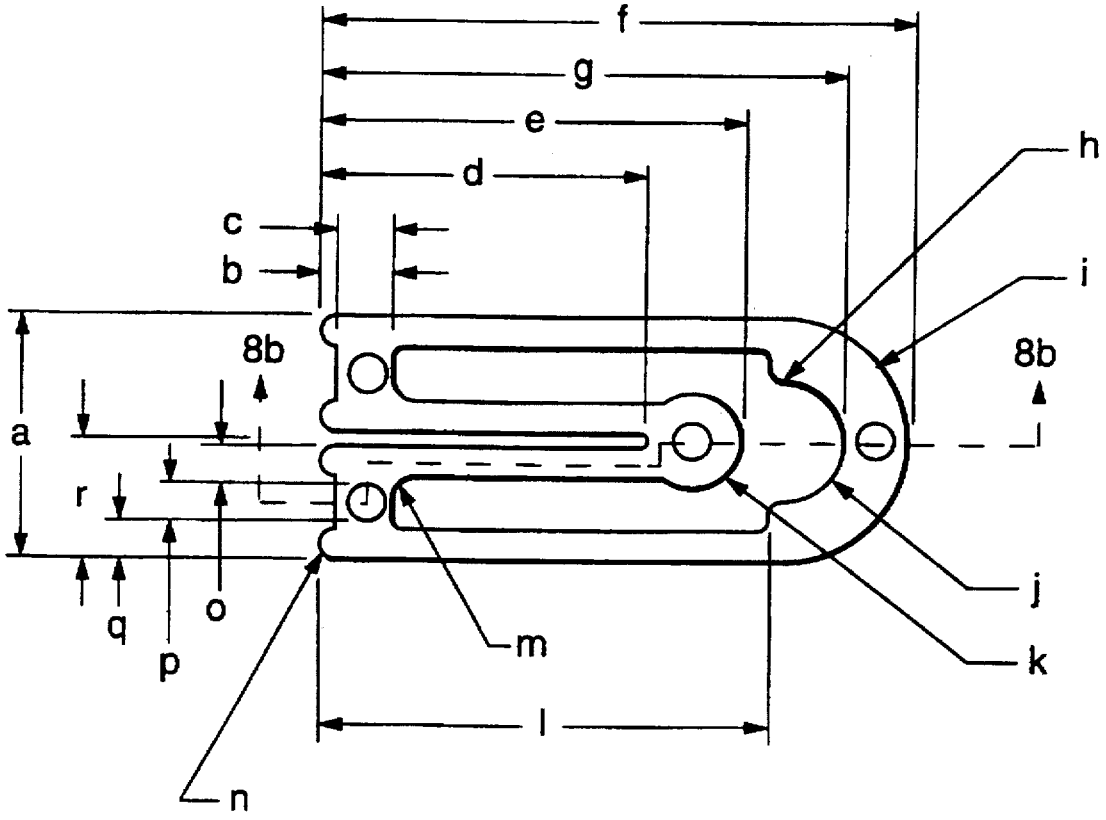
FIG. 8*a* is a detail view of another one of clips of FIG. 6, with typical dimensions indicated.
Figure 8B:
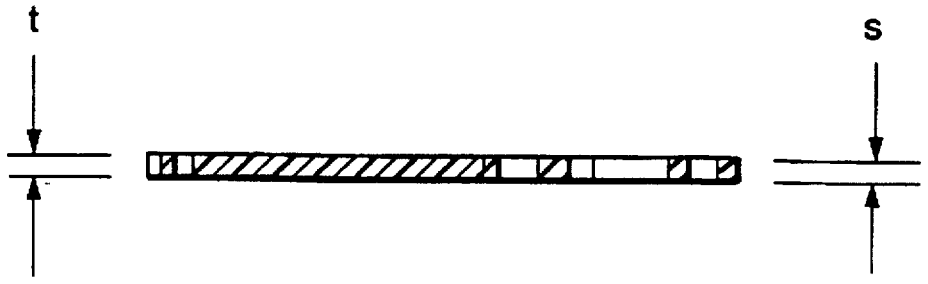
FIG. 8*b* is a cross-sectional view of FIG. 8*a*, taken along the line 8*b*—8*b;*

The Clips of FIGS. 6, to 8*b*

FIG. 6 illustrates a sheet of clips 95 that has approximately the area of a stack of conventional loose leaf notebook paper sheets or tabbed separators 97. This sheet of clips comprises a frame 99 having inner and outer side rims 98, 100, upper and lower cross rims 102, 104, and intermediate cross ribs 106, 108, 110. Inner side rim 98 is provided with holes 112, including a central pilot hole 114, for receiving the rings of a three ring binder. It will be observed that sheet of clips 96 includes rows of small clips 116 and rows of large clips 118.

Figure 7A:
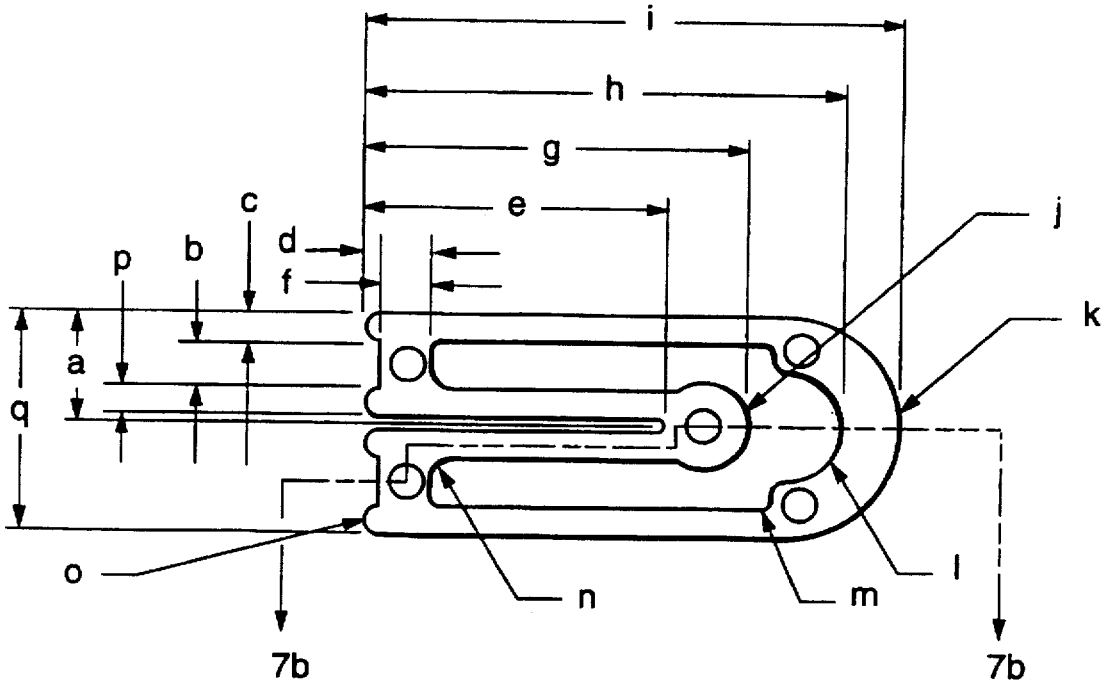
FIG. 7*a* is a detail view of one of the clips of FIG. 6, with typical dimensions indicated.
Figure 7B:
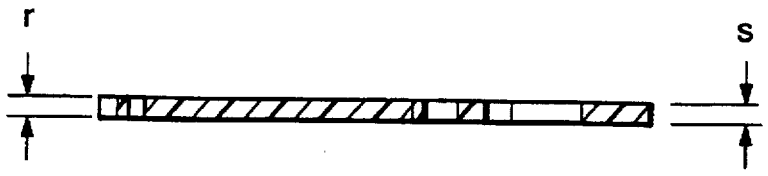
FIG. 7*b* is a cross-sectional view of FIG. 7*a*, taken along the line 7*b*—7*b;*

Dimensions of one of large clips 118 are shown in FIGS. 7*a* and 7*b*, as follows:

| Dimension | Inches (R = radius) |
|---|---|
| a | 0.314 |
| b | 0.137 |
| c | 0.080 |
| d | 0.164 |
| e | 0.752 |
| f | 0.129 |
| g | 0.980 |
| h | 1.197 |
| i | 1.358 |
| j | R 0.125 |
| k | R 0.314 |
| l | R 0.164 |
| m | R 0.018 |
| n | R 0.063 |
| o | R 0.031 |
| p | 0.072 |
| q | 0.628 |
| r | 0.065 |
| s | 0.051 |

Dimensions of one of small clips 116 are shown in FIGS. 8*a* and 8*b* as follows:

| Dimension | Inches (R = radius) |
|---|---|
| a | 0.477 |
| b | 0.160 |
| c | 0.125 |
| d | 0.561 |
| e | 0.759 |
| f | 1.033 |
| g | 0.900 |
| h | R 0.031 |
| i | R.0.239 |
| j | R.0.124 |
| k | R.0.100 |
| l | 0.754 |
| m | R.0.050 |
| n | R 0.018 |
| o | 0.063 |
| p | 0.088 |
| q | 0.063 |
| r | 0.239 |
| s | 0.043 |
| t | 0.055 |

The Sheet of Clips of FIGS. 9 to 14

Figure 9:
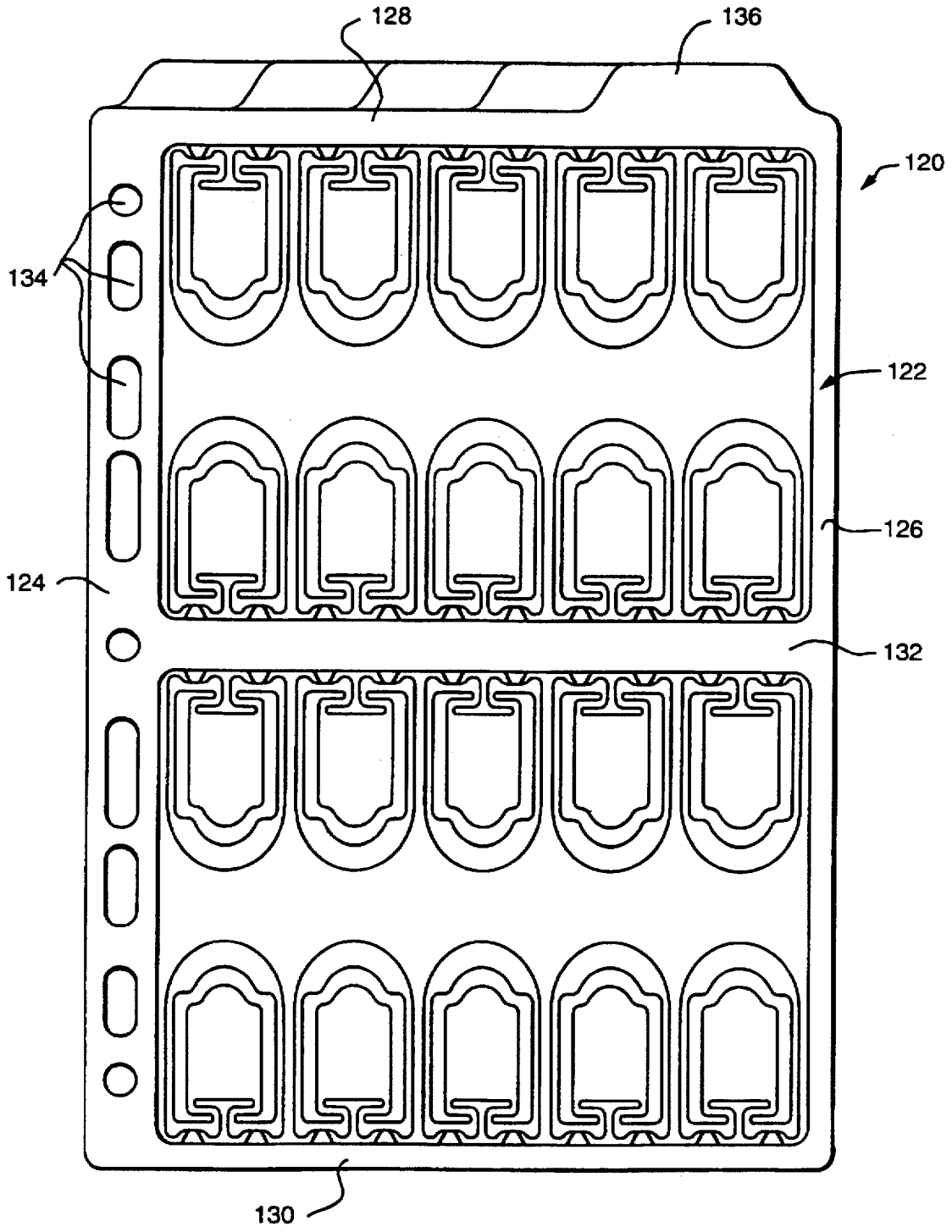
FIG. 9 is a plan view of a further sheet of clips embodying the present invention.

FIG. 9 illustrates a sheet of clips 120 that comprises a frame 122 having opposed inner and outer side rims 124, 126, opposed top and bottom rims 128, 130, and a medial cross rib 132. Side rims 124, 126 are parallel. Rims 128, 130 and rib 132 are perpendicular with respect thereto. Frame 122 is sufficiently thick to ensure dimensional stability. Inner rim 124 includes holes 134 for the reception of the three rings of loose leaf notebook 30 and the retention of the frame in the notebook. Frame 122 also includes an upwardly extending tab 136 for ready identification among associated loose leaf sheets of paper.

Figure 10:
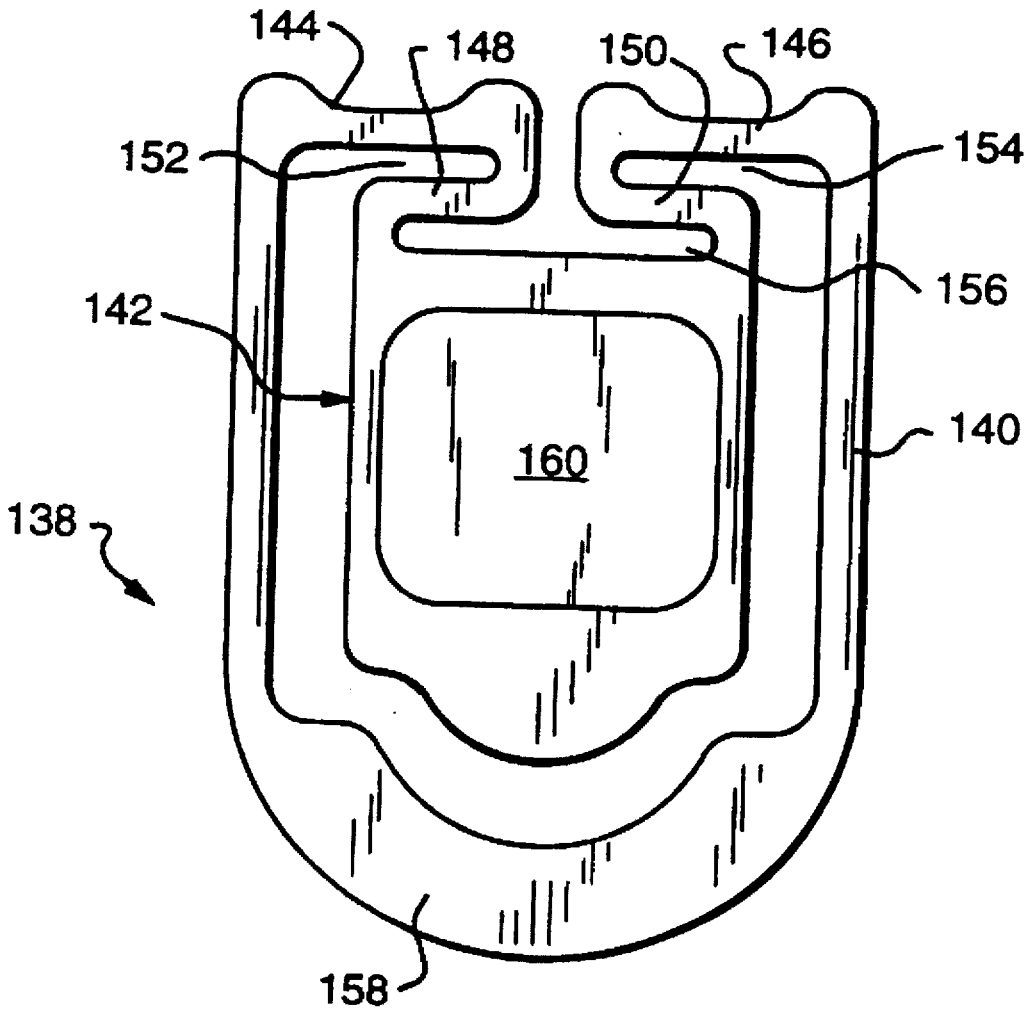
FIG. 10 is a front plan view of one version of a clip of FIG. 9.

One of the clips of FIG. 9 is shown in detail in FIG. 10 at 138. This clip comprises an outer retainer in the form of an arch 140, and an inner retainer in the form of a tablet 142. At the upper end of the clip is a split yoke 144, 146. The outer portions of the yoke are connected to the legs of outer retainer 140. The inner portions of the yokes are connected to tablet 142 by articulations 148, 150, which extend inwardly from outer edges of the tablet and upwardly to the inner edges of the split yoke. In effect, the yoke is provided with horizontal co-axial slots 152, 154, and the upper edge of the tablet is provided with a horizontal slot 156. It will be observed that the transverse dimension of each of the legs of outer retainer 140 is significantly smaller than the vertical dimension of the tip 158 of outer retainer 140.

The forward face of tablet 142 is provided with visual configurations for informational, artistic or advertising purposes. In one form the face of the tablet is imprinted with ink. In another form the face of the tablet is provided with molded and raised visual configurations. In a further form, the surface of the tablet is provided with microstriations that enable manual marking with a pen. The rearward face of the tablet is provided with grooves that enable the tablet to be flexed slightly when the clip is in use. These grooves typically range in depth from 70% to 90% of the thickness of the tablet.

Figure 11A:
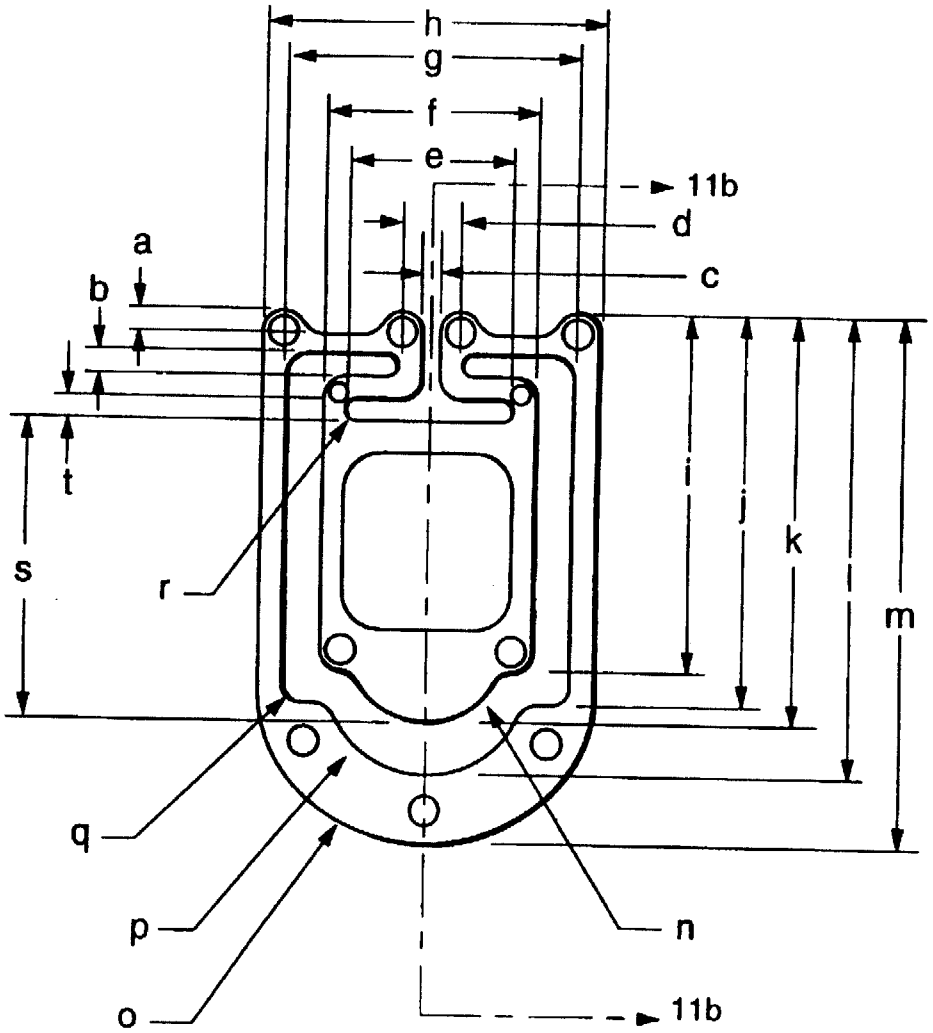
FIG. 11*a* is a detail view of the clips of FIG. 11*a*, with typical dimensions indicated.
Figure 11B:
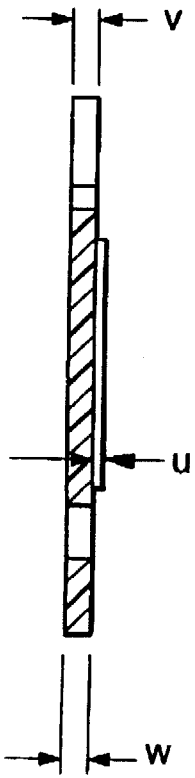
FIG. 11*b* is a cross sectional view of FIG. 8*a*, taken along the line 11*b*—11*b;*
Figure 12:
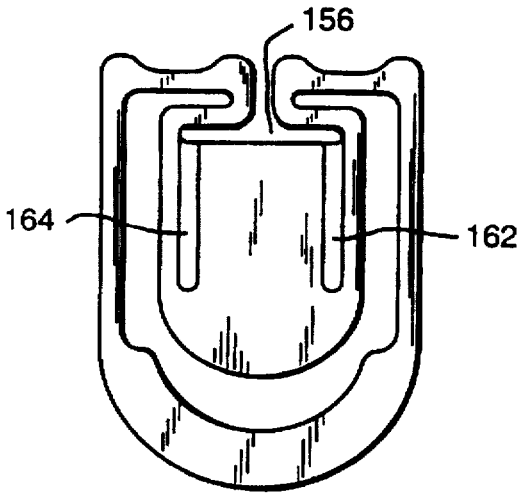
FIG. 12 is a rear plan view of a first version of the clip of FIG. 10.
Figure 13:
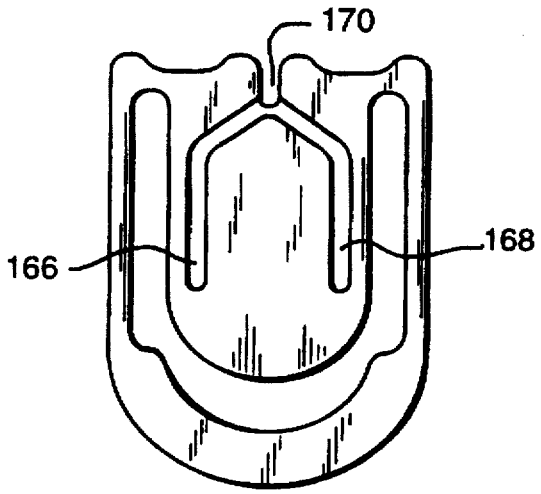
FIG. 13 is a rear plan view of second version of the clip of FIG. 10.
Figure 14:
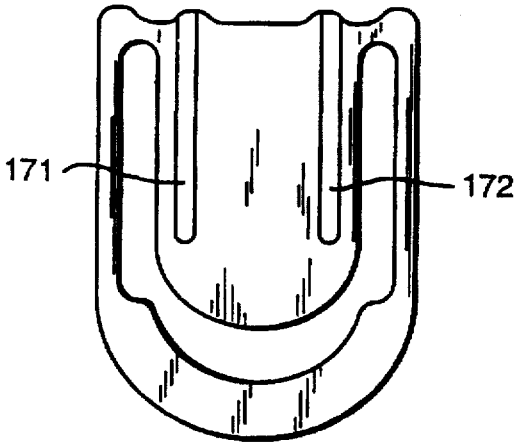
FIG. 14 is a rear plan view of a third version of the clip of FIG. 10.

FIG. 12 illustrates an embodiment in which the rearward face of the tablet is provided with grooves 162, 164 that extend longitudinally of the tablet from slot 156 in parallel with the legs of outer retainer 140. FIG. 13 illustrates another embodiment in which slot 156 is omitted and a pair of grooves 166, 168 extend from a vertical slot 170 at the center of the yoke, first obliquely and outwardly toward the opposite edges of the tablet and thence downwardly and in parallel with the opposite edges of the tablet. FIG. 14 illustrates another embodiment in which the upper edge of the clip is not bifurcated and parallel grooves 171, 172 extend downwardly and in parallel from the upper edge of the clip and along its opposed edges. Dimensions of clip 138 are shown in FIG. 11 as follows.

| Dimension | Inches (R = radius) |
|---|---|
| a | 0.060 |
| b | 0.062 |
| c | 0.063 |
| d | 0.189 |
| e | 0.525 |
| f | 0.650 |
| g | 0.890 |
| h | 1.035 |
| i | 1.049 |
| j | 1.141 |
| k | 1.200 |
| l | 1.350 |
| m | 1.550 |
| n | 0.217 |
| o | 0.500 |
| p | 0.300 |
| q | R 0.063 |
| r | 0.030 |

-continued

| Dimension | Inches (R = radius) |
|---|---|
| s | 0.891 |
| t | 0.080 |
| u | 0.060 |
| v | 0.001 |

Figure 15:
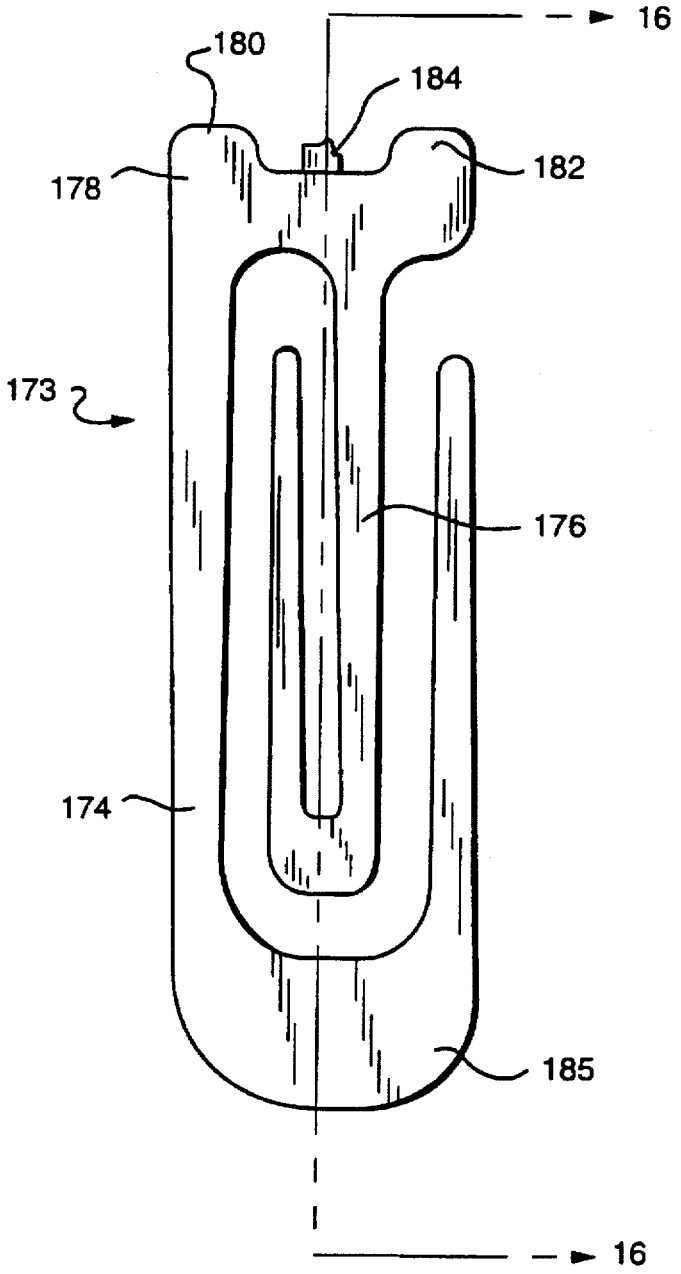
FIG. 15 is a plan view of another clip embodying the present invention.
Figure 16:
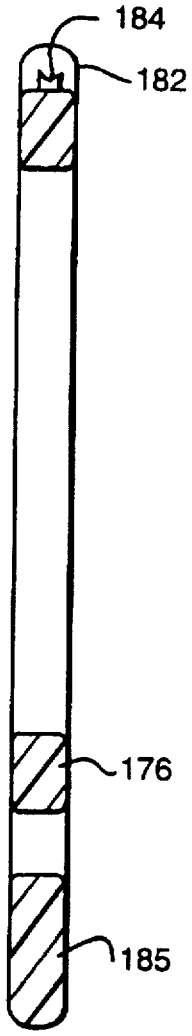
FIG. 16 is a cross-sectional view of the clip of FIG. 15, taken along the line 16—16.

The Clip of FIGS. 15 and 16

Another clip embodying the present invention is shown at 173 as including an outer retainer in the form of an elongated arch 174 and an inner retainer in the form of an elongated arch 176. Only one leg of each of these retainers is connected to a continuous yoke 178. At the outer edges of the yoke are a pair of knurls 180, 182. Between these knurls is a residual burr 184 where the clip has been disconnected from the frame of the sheet of clips by which it initially was carried. As shown, yoke 178 and tip 185 have relatively wide axial dimensions and the legs of the elongated retainers have relatively narrow transverse dimensions.

Figure 17:
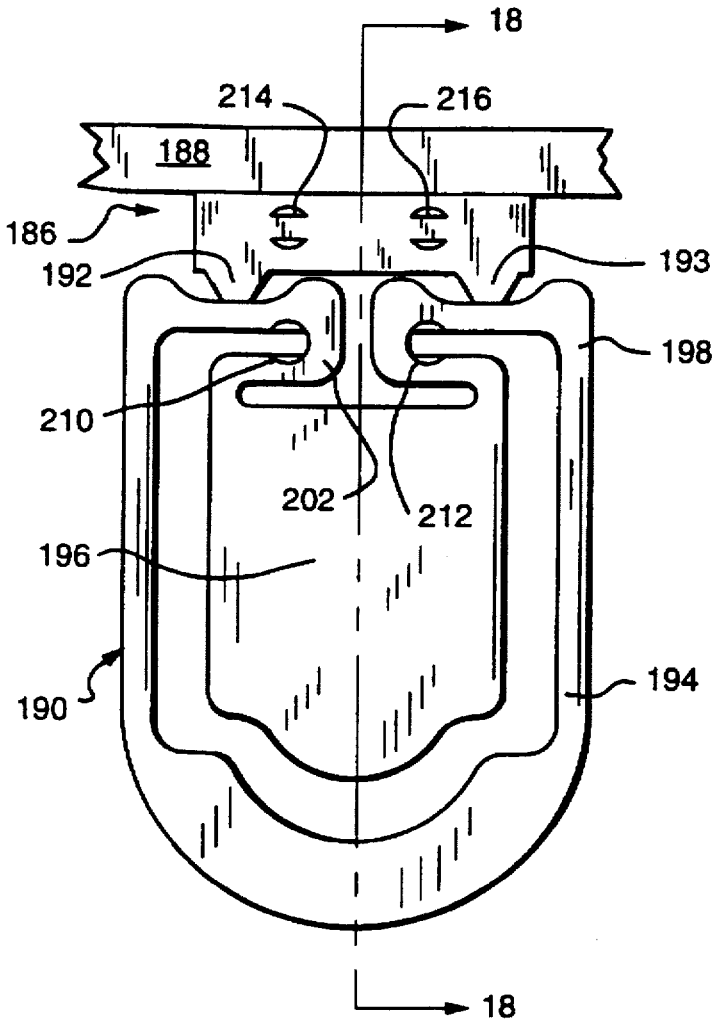
FIG. 17 is a plan view of another clip and fragmentary frame configuration embodying the present invention.
Figure 18:
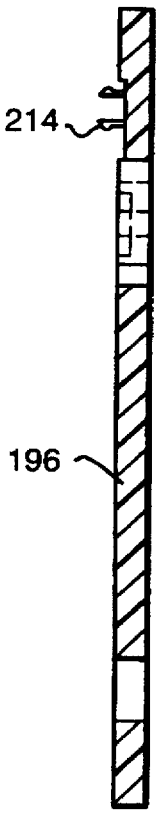
FIG. 18 is a cross-sectional view of the configuration of FIG. 17, taken along the line 18—18.

The Clip and Frame of FIGS. 17 and 18.

Another structure embodying the present invention is shown at 186 as including a frame 188 and a plurality of clips, one of which is shown at 190. Frame 188 and clip 190 are integrally connected by junctions 192, 193 that are analogous to the junctions described above in connection with FIGS. 4 through **5*b***.

As shown, clip 190 comprises an outer retainer in the form of an arch 194, and an inner retainer in the form of a tablet 196. At the upper end of the clip is a bifurcated yoke 198. The outer portions of the yoke are connected to the legs of outer retainer 194. The inner portion of the yoke are connected to tablet 196 by junctions 202. The upper slots that lie between the yoke and the tablet terminate at a pair of adjacent eyelets 210, 212. Mounted on frame 188 and adjacent to clip 190 are a pair of adjacent split resilient locking pins 214, 216. The arrangement is such that, after clip 190 has been separated from frame 188 for use, it may be removably re-attached to the frame by snapping eyelets 210, 212 onto locking pins 214, 216.

Figure 19:
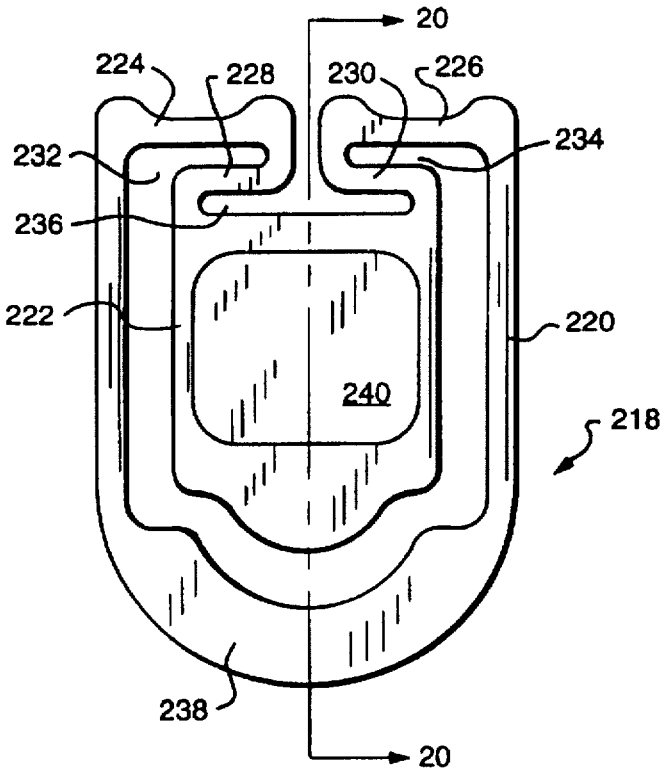
FIG. 19 is a top plan view of still another clip embodying the present invention.

The Clips of FIGS. 19 and 20

Another type of clip embodying the present invention is shown in detail in FIG. 19 at 218. This clip comprises an outer retainer in the form of an arch 220, and an inner retainer in the form of a tablet 222. At the upper end of the clip is a split yoke 224, 226. The outer portions of the yoke are connected to the legs of outer retainer 220. The inner portions of the yokes are connected to tablet 222 by articulations 228, 230, which extend inwardly from outer edges of the tablet and upwardly to the inner edges of the split yoke. In effect, the yoke is provided with horizontal co-axial slots 232, 234, and the upper edge of the tablet is provided with a horizontal slot 236. It will be observed that the transverse dimension of each of the legs of outer retainer 220 is significantly smaller than the vertical dimension of the tip 238 of outer retainer 220.

In one form, the forward face of the tablet is imprinted with an inked region 240. In another form, the forward face of the tablet is embossed with alphanumeric indicia and/or graphics. In a further form, the forward face of the tablet has a micro striated surface that can be marked with pen and ink.

Figure 20A:
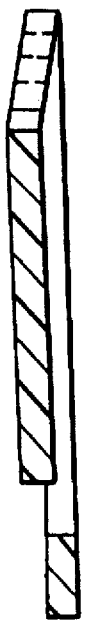
FIG. 20*a* is a cross-sectional view of one version of the clip of FIG. 19, taken along the line 20*a*—20*a*.
Figure 20B:
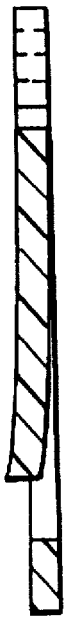
FIG. 20*b* is a cross-sectional view of another version of the clip of the FIG. 19, taken along the line 20*b*—20*b*.
Figure 20C:
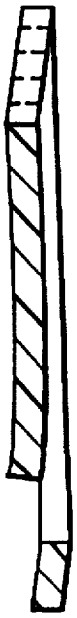
FIG. 20*c* is a cross-sectional view of a further version of the clip of FIG. 19, taken along the line 20*c*—20*c;*

Three cross-sectional versions of the clip of FIG. 19 are shown in FIGS. **20*a*, 20*b* and 20*c*. In FIG. 20*a*, the yoke is pitched outwardly from the arch so that the tablet is located in a plane that is parallel to the plane of the arch. In FIG. 20*b*, the tablet is curved outwardly away form the plane of the arch. And in FIG. 20*c*, the yoke is pitched outwardly from the arch and the tablet is curved outwardly. Each of the embodiments of FIGS. 20*a*, 20*b* and 20*c*** is designed so that both retainers lie flat against the sheets that they clasp therebetween.

Figure 21A:
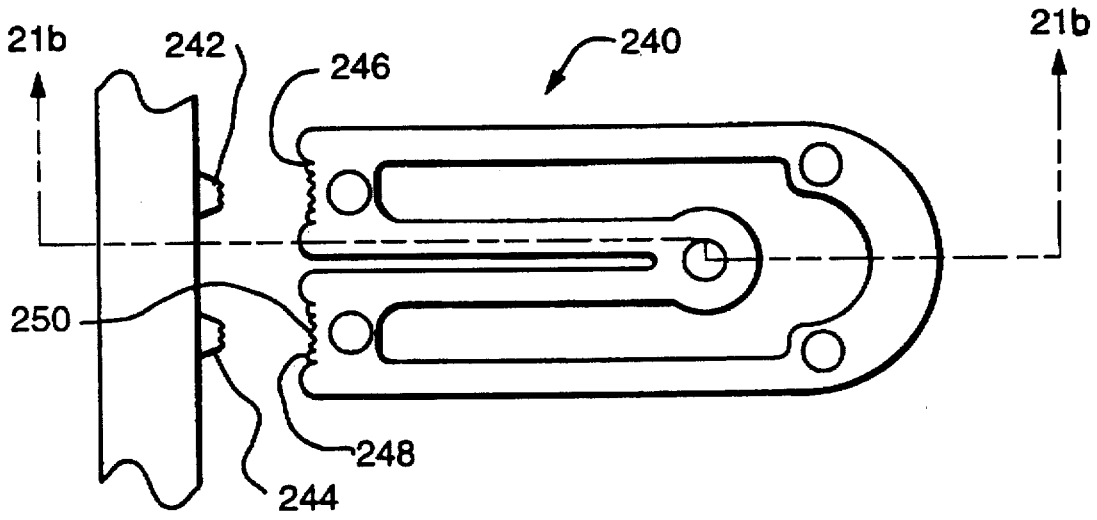
FIG. 21*a* is an enlarged fragmentary view of a portion of another sheet of clips, showing a ruptured junction between the clip and a part of the frame.
Figure 21B:
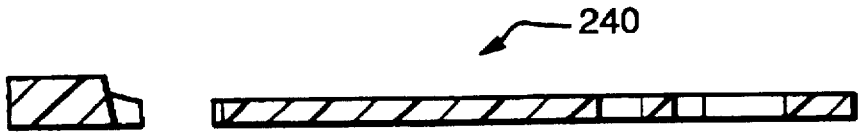
FIG. 21*b* is a cross section of FIG. 21*a*, taken along the line 21*b*—21*b*.

The Clips of FIGS. 21*a* and 21*b*

As seen in FIGS. **21*a*, 21*b*, each clip 240 is integrally connected to a rib or a rim by a pair of junctions 242, 244. These junctions conically or pyramidally converge from one of the rims or ribs, for example from a rib, to positions on the split yoke. Each of these junctions is straddled by a series of projections or knurls 246, 248 on the yoke. When the junctions are ruptured by repeated bending of the clip with respect to the frame, the clip becomes free for use and a burr 250** ordinarily remains among the knurls. Were it not set among knurls, the burr might scratch the fingers of a user and would appear as a visual imperfection. This burr instead is seen as a feature of the ornamentally knurled split yokes.

Operation

Any of the illustrated sheets of clips is designed for mounting in a notebook having outer covers and a spine. The sheet of clips comprises a frame having inner and outer side rims, top and bottom cross rims, and optionally at least a rib connected between a pair of the rims. The frame includes a set of paper clips integrally connected to the frame via the rims and the rib. Each of said clips includes an outer retainer, an inner retainer and a yoke connecting the outer retainer and the inner retainer. The junction extending between the frame and the yoke is rupturable so that by bending the clip back and forth with respect to the frame a few times, the clip become detached and ready for use.

What is claimed is:

1. For mounting in a notebook having outer covers and a spine, a sheet of clips comprising:

(a) a frame having inner and outer side rims, top and bottom cross rims, and optionally at least a rib connected between a pair of said rims;

(b) a set of paper clips integrally connected to said frame via said rims and said rib;

(c) each of said clips including an outer retainer, an inner retainer, and a yoke connecting said outer retainer and said inner retainer;

(d) said outer retainer being an elongated arch and said inner retainer being an elongated arch, one leg of said inner retainer and one leg of said outer retainer being connected to said yoke;

(e) at least one rupturable junction extending between said frame and said yoke; and (f) a configuration on said inner rim for connection to said spine.

2. The sheet of clips of claim 1 wherein said spine includes rings and said frame includes holes for receiving said rings.

3. The sheet of clips of claim 1 wherein said spine includes a helical coil and said frame includes catches for projecting through loops of said helical coil and for preventing removal from said loops of said helical coil.

4. The sheet of clips of claim 1 wherein at least a pair of knurls on said yoke straddles said junction.

5. The sheet of clips of claim 1 wherein said frame is thicker than said clips.

6. The sheet of clips of claim 1 wherein said frame provides pins and said clips provide openings for receiving said pins for reattachment to said frame after said clips have been removed from said frame.

7. The sheet of clips of claim 1 wherein said inner and outer retainers, in cross-section, lie in different planes.

8. The sheet of clips of claim 1 wherein at least one of said inner and outer retainers, in cross-section, are curved with respect to each other.

9. For mounting in a notebook having outer covers and a spine, a sheet of clips comprising:

(a) a frame having inner and outer side rims, top and bottom cross rims, and optionally at least a rib connected between a pair of said rims;

(b) a set of paper clips integrally including outer retainers, inner retainers, and yokes connecting said outer retainers and said inner retainers;

(c) said outer retainer being an elongated arch and said inner retainer being an elongated arch, one leg of said inner retainer and one leg of said outer retainer being connected to said yoke;

(d) at least one rupturable junction extending between said frame and said yokes; and (e) configurations on said yokes for straddling said junctions.

10. The sheet of clips of claim 9 wherein said spine includes rings and said frame includes holes for receiving said rings.

11. The sheet of clips of claim 9 wherein said spine includes a helical coil and said frame includes catches for projecting through loops of said helical coil and for preventing removal from said loops of said helical coil.

12. The sheet of clips of claim 9 wherein at least a pair of knurls on said yoke straddles said junction.

13. The sheet of clips of claim 9 wherein said frame is thicker than said clips.

* * * * *